US008220591B2

(12) United States Patent
Atalla et al.

(10) Patent No.: US 8,220,591 B2
(45) Date of Patent: Jul. 17, 2012

(54) GROUP ELEVATOR SCHEDULING WITH ADVANCE TRAFFIC INFORMATION

(75) Inventors: Mauro J. Atalla, South Glastonbury, CT (US); Arthur C. Hsu, South Glastonbury, CT (US); Peter B. Luh, Storrs, CT (US); Gregory G. Luther, West Hartford, CT (US); Bo Xiong, Storrs, CT (US)

(73) Assignees: Otis Elevator Company, Farmington, CT (US); University of Connecticut, Farmington, CT (US)

( * ) Notice: Subject to any disclaimer, the term of this patent is extended or adjusted under 35 U.S.C. 154(b) by 787 days.

(21) Appl. No.: 11/918,149

(22) PCT Filed: Apr. 14, 2006

(86) PCT No.: PCT/US2006/014360

§ 371 (c)(1), (2), (4) Date: Nov. 3, 2008

(87) PCT Pub. No.: WO2006/113598

PCT Pub. Date: Oct. 26, 2006

(65) Prior Publication Data

US 2009/0216376 A1 Aug. 27, 2009

Related U.S. Application Data

(60) Provisional application No. 60/671,698, filed on Apr. 15, 2005.

(51) Int. Cl.
*B66B 1/20* (2006.01)

(52) U.S. Cl. ..... 187/383; 187/391

(58) Field of Classification Search ..... 187/247, 187/248, 380–388, 391–393; 700/28, 29; 706/910

See application file for complete search history.

(56) References Cited

U.S. PATENT DOCUMENTS 4,355,705 A 10/1982 Schroder et al.
5,672,853 A * 9/1997 Whitehall et al. ..... 187/380
5,780,789 A * 7/1998 Tsuji ..... 187/382

(Continued)

FOREIGN PATENT DOCUMENTS

JP 60-213672 10/1985

(Continued)

OTHER PUBLICATIONS

Office Action, May 10, 2011, 2 pages.

*Primary Examiner* — Anthony Salata
(74) *Attorney, Agent, or Firm* — Kinney & Lange, P.A.

(57) ABSTRACT

A near-optimal scheduling method for a group of elevators uses advance traffic information. More particularly, advance traffic information is used to define a snapshot problem (24) in which the objective is to improve performance for customers. To solve the snapshot problem (24), the objective function is transformed into a form to facilitate the decomposition of the problem into individual car subproblems (26). The subproblems (26) are independently solved using a two-level formulation, with passenger to car assignment (28) at the higher level, and the dispatching of individual cars (30) at the lower level. Near-optimal passenger selection and individual car routing (38) are obtained. The individual cars are then coordinated through an iterative process (40, 42) to arrive at a group control solution that achieves a near-optimal result for passengers.

21 Claims, 6 Drawing Sheets

U.S. PATENT DOCUMENTS

| | | | | |
|---|---|---|---|---|
| 6,241,050 | B1 | 6/2001 | Hikita et al. | |
| 6,293,368 | B1 * | 9/2001 | Ylinen et al. | 187/382 |
| 6,496,110 | B2 * | 12/2002 | Peterson et al. | 340/522 |
| 6,644,442 | B1 * | 11/2003 | Ylinen et al. | 187/382 |
| 6,776,264 | B2 * | 8/2004 | Tyni et al. | 187/382 |
| 6,913,117 | B2 * | 7/2005 | Tyni et al. | 187/382 |
| 7,014,015 | B2 | 3/2006 | Nikovski et al. | |
| 7,140,472 | B2 * | 11/2006 | Tyni et al. | 187/382 |
| 7,275,623 | B2 | 10/2007 | Tyni et al. | |
| 7,484,597 | B2 * | 2/2009 | Nikovski et al. | 187/382 |
| 7,546,905 | B2 * | 6/2009 | Nikovski et al. | 187/380 |
| 7,546,906 | B2 * | 6/2009 | Tyni et al. | 187/382 |
| 2007/0221455 | A1 | 9/2007 | Nikovski et al. | |
| 2011/0115907 | A1 * | 5/2011 | Cameron | 348/143 |

FOREIGN PATENT DOCUMENTS

| | | | |
|---|---|---|---|
| JP | 63-6469 | | 2/1988 |
| JP | 1-38752 | | 8/1989 |
| JP | 11-503706 | | 3/1999 |
| JP | 2003132500 | A | 5/2003 |
| JP | 2004-155554 | A | 6/2004 |
| WO | 9633123 | | 10/1996 |

* cited by examiner

GROUP ELEVATOR SCHEDULING WITH ADVANCE TRAFFIC INFORMATION

REFERENCE TO RELATED APPLICATION

This application claims priority from U.S. Provisional Patent Application Ser. No. 60/671,698, filed Apr. 15, 2005, which is hereby incorporated by reference.

BACKGROUND OF THE INVENTION

The invention relates to the field of elevator control, and in particular to the scheduling of elevators operating as a group in a building.

Group elevator scheduling has long been recognized as an important issue for transportation efficiency. The problem, however, is difficult because of hybrid system dynamics, combinatorial explosion of the state and decision spaces, time-varying and uncertain passenger demand, strict operational constraints, and realtime computational requirements for online scheduling.

Recently, elevator systems with destination entry have been introduced. In a destination entry system, passengers are asked to register their destination floors before they are serviced. More information is thus available for group elevator scheduling, since passenger destinations are now known when deciding on car assignments. Furthermore, with the progress in information technology, one promising direction is to use advance traffic information from various new sensor or demand estimation technologies to reduce uncertainties and significantly improve the performance. Near-optimal scheduling with advance traffic information will lead to better performance as compared to scheduling determined without the use of advance traffic information.

BRIEF SUMMARY OF THE INVENTION

The subject invention is directed to a scheduling method for a group of elevators using advanced traffic information. More particularly, advanced traffic information is used to define a snapshot problem in which the objective is to improve performance for customers. To solve the snapshot problem, the objective function is transformed into a form to facilitate the decomposition of the problem into individual car subproblems. The subproblems are independently solved using a two-level formulation, with passenger to car assignment at the higher level, and the dispatching of individual cars at the low level. Near-optimal passenger selection and individual car routing are obtained. The individual cars are then coordinated through an iterative process to arrive at a group control solution that achieves a near-optimal result for passengers. The method can be extended to cases with little or no advance information; operation of elevator parking; and coordinated emergency evacuation.

DETAILED DESCRIPTION

Figure 1:
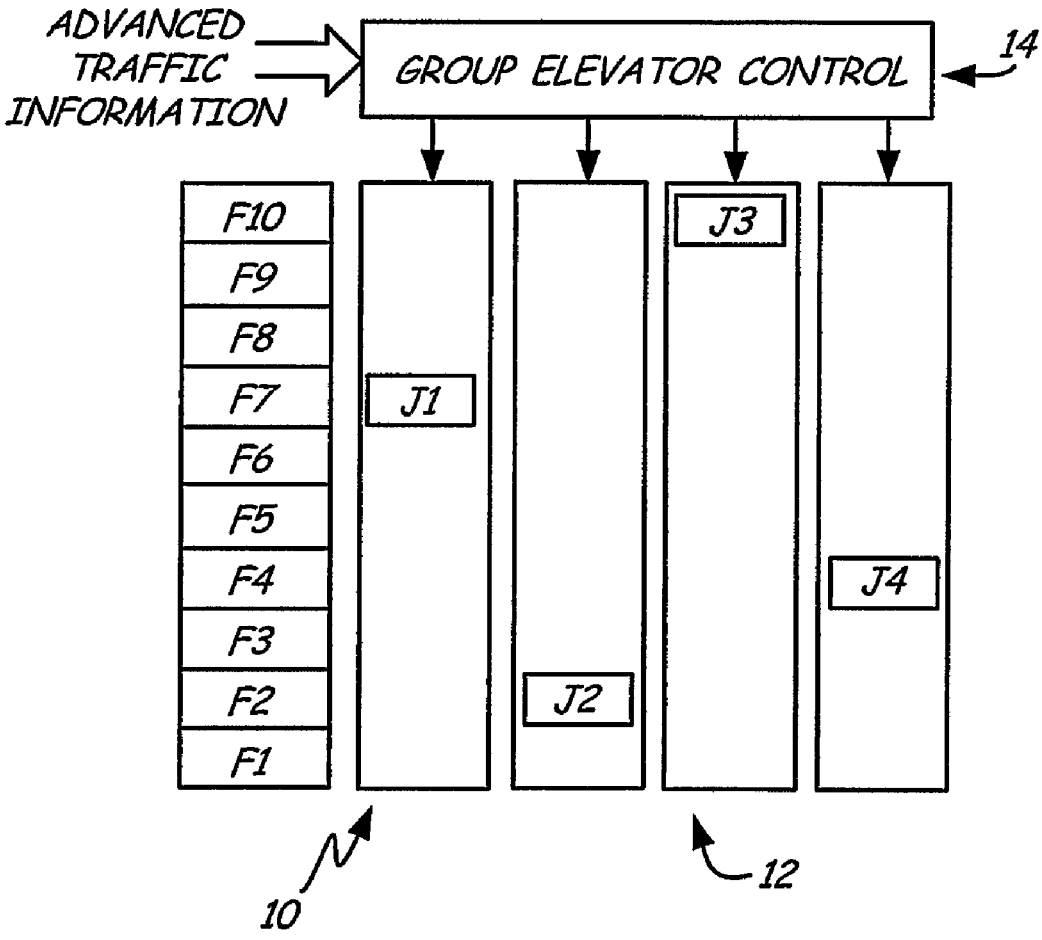
FIG. 1 is an illustration of a group of elevators controlled using advance traffic information.

FIG. 1 shows building 10 having ten floors F1-F10 serviced by a group of four elevators 12. Cars J1-J4 move within the shafts of elevators 12 under the control of group elevator control 14. The scheduling of cars J1-J4 is coordinated based upon inputs representing actual or predicted requests for service.

Group elevator control 14 receives demand information inputs that provide information about an $t_i$ arrival time of passenger i, an arrival floor $f_i^a$ for passenger i, and a destination floor $f_i^d$ for passenger i. One source of traffic information inputs is a destination entry system having a keypad located at a distance from the elevators, so that the passenger requests service by keying in the destination floor prior to boarding the elevator. Other sources of advance traffic information include sensors in a corridor leading to the landing, video cameras, identification card readers, and computer systems networked to the group elevator control to provide advance reservations or requests for cars to specific destination floors based upon predicted demand. For example, a hotel conference schedule system can interface with group elevator control 14 to provide information as to when meetings will start or end and therefore generate a demand for elevator service.

Group elevator control 14 is a computer-based system that makes use of expected or known future traffic demands to make decisions on how to assign passengers to cars, and how to dispatch cars to pick up and deliver the passengers. Using advance traffic information, group elevator control 14 provides enhanced performance of the elevators in serving passengers. One among several possible choices for performance metric is to reduce the total service time of all passengers requesting service. This, or any other, objective must be met in a way that is consistent with passenger-car assignment constraints and car capacity constraints, and obeys car dynamics.

Advance traffic information is used by group elevator control 14 to select information from the inputs that falls within a window. With each window snapshot, the advance traffic information is used to formulate an objective function that optimizes customer performance.

In operating an elevator group, such as shown in FIG. 1, elevators 12 are independent, yet individual cars J1-J4 of the elevator group are coupled through serving a common pool of passengers. For each passenger, there is one and only one elevator that will serve that passenger. However, once the sets of passengers are assigned to individual cars, the dispatching of one car is independent from the other cars.

This coupled yet separable problem structure is used by group elevator control 14 to establish a simple, yet innovative, two-tier formulation: passenger assignment is at the higher level, and single car dispatching is at the lower level.

The elevator dispatching problem is decomposed into individual car subproblems through the relaxation of passenger-car assignments constraints. Then, for each car, a search is performed to select the best set of passengers to be served by that car. Single car dynamics and car capacity constraints are embedded in a single car simulation model to yield the best set of passengers with the best performance for each car. The results for the individual cars are then coordinated through an iterative process of updating multipliers to arrive at a near-optimal solution for customers. The above method can be extended to cases with little or no advance information; operation of elevator parking; and coordinated emergency evacuation.

Look-ahead windows are used to model advance demand information, where known or estimated traffic within the window is considered. Passenger-to-car assignment constraints are established as linear inequality constraints, and are "coupling" constraints since individual cars are coupled through serving a common pool of passengers. Car capacity constraints and car dynamics are embedded within individual car simulation models. The objective function is flexible within a range of passenger-wise, car-wise and building-wise measures, e.g., passenger wait time, service time or elevator energy required, or number of car stops experienced during a passenger trip.

As illustrated by the example shown in FIG. 1, the system is a building having F floors and J elevators. The parameters of the elevators are given, including car dynamics and car capacity constraints. The current state of the elevator group, in addition to the car dynamics and car capacity constraints, includes each elevator's operating state: for example, the passengers already assigned to the cars, the positions of the cars with in the hoist way, whether the cars are accelerating, decelerating, car direction, car velocity. For example, a car stopped at a floor with doors opened, a car moving between floors, etc.

Advance traffic information is modeled by a look-ahead window. Advance traffic information as specified by the arrival time $t_i^a$, the arrival floor $f_i^a$, and the destination floor $f_i^d$ of each passenger i who arrives within the window is assumed known. Advance traffic information may be distinguished from the current state of the elevator group in that advance traffic information relates to passengers not yet assigned to a car. Cases with different amounts of advance traffic information, such as those resulting from different passenger interfaces or demand estimation methods, can be handled by adjusting the window size. A rolling horizon scheme is then used in conjunction with windows, and snapshot problems are re-solved periodically or as needed. For a snapshot problem, let $S_p$ denote the set of $I_p$ passengers who have been picked up but not yet delivered to their destination floors, and $S_c$ the set of $I_c$ passengers who have not yet been picked up. Together there are I passengers ($I=I_c+I_p$) to be delivered to their destination floors. This method allows great flexibility in choosing when to commit to an assignment. The amount $I_c$ of passengers can vary between 1 and I, allowing for various commitment policies. Once the problem is solved, group elevator control 14 will only commit to the assignment of a subset of $I_c$ passengers who will be picked up before the next rescheduling point, and will postpone commitments of other passengers.

Constraints to be considered include coupling constraints among cars and individual car constraints. The former includes passenger-to-car assignment constraints stating that each passenger must be assigned to one and only one car, i.e., $$\sum_{j=1}^{J} \delta_{ij} = 1, \ \forall\, i, \tag{1}$$

where $\delta_{ij}$ is a zero-one indexing variable equal to one if passenger i is assigned to car j and zero otherwise. For a snapshot problem, $\delta_{ij}$ for all $i \in I_p$ (i.e., passengers who have been picked up but not yet delivered to their destination floors) are fixed, and only $\delta_{ij}$, for all $i \in I_c$ (i.e., passengers who are not yet picked up and are to be delivered) by are to be optimized. Note that individual cars are coupled since they have to serve a common pool of passengers. Individual car constraints include car capacity constraints:

$$\sum_{i=1}^{I} \zeta_{ijt} \le C_j, \ \forall\, j, t, \tag{2}$$

where $C_j$ is the capacity of car j, and $\zeta_{ijt}$ is a zero-one indexing variable equal to one if passenger i is in car j at time t and zero otherwise ($\zeta_{ijt}=1$ iff $t_i^p \leqq t < t_i^d$). In the above, the pickup time $t_i^p$ and the departure time $t_i^d$ of passenger i depend only on how individual cars are dispatched for a given assignment, and are represented by a dispatching strategy $\phi$:

$$\{t_i^p, t_i^d\} = \phi(\{t_{i'}^a, f_{i'}^a, f_{i'}^d, \forall i' \in S_j\}), \text{ where } S_j \equiv \{i' \mid \delta_{i'j}=1\} \text{ and } i \in S_j. \tag{3}$$

In view that the number of variables $\{\zeta_{ijt}\}$ is large and the function $\phi$ could be too complicated to describe, constraints (2) and (3) are not explicitly represented but are embedded in simulation models of individual cars. Other elevator parameters such as door opening time, door dwell time (the minimum time interval that the doors keep open), door closing time, and loading and unloading times per passenger are also used in the simulation models.

Figure 2:
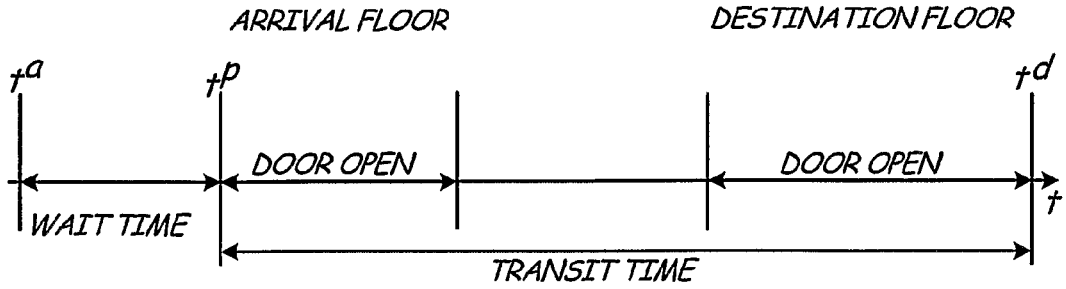
FIG. 2 is a diagram illustrating time metrics between passenger arrival time and departure time.

The objective for group elevator control 14 is that scheduling shall lead to higher customer (passengers or building managers) satisfaction in terms of certain performance criteria. One possibility enabled by this method is to focus on a weighted sum of wait time. For example, for passenger i, the wait time $T_i^W$ is the time interval between passenger i's arrival time and the pickup time ($T_i^W \equiv t_i^p - t_i^a$), the transit time is the time interval between the pickup time and the departure time ($T_i^T \equiv t_i^d - t_i^p$). The service time $T_i$ is the sum of the above two, or the difference between the arrival time and the departure time ($T_i^S \equiv t_i^d - t_i^a$). The time definitions are shown in FIG. 2. The wait time is the time interval between the arrival time and the pickup time. The transit time is the time interval between the pickup time and the departure time. In this example the objective is to minimize a weighted sum of wait times and transit times of all passengers, i.e., $$\min_{\left\{\begin{matrix}\delta_{ij}, \forall i \in S_c, \forall j \\ t_i^p, \forall i \in S_c \cup S_p\end{matrix}\right\}} J, \quad \text{with } J \equiv \sum_{i=1}^{I} T_i, \tag{4}$$

$$\text{where } T_i = \alpha(t_i^p - t_i^a) + \beta(t_i^d - t_i^p) = \alpha T_i^w + \beta T_i^T \tag{5}$$

In the above, $\alpha$ and $\beta$ are weights specified by designers. Note that when $\alpha=\beta=1$, then $T_i=T_i^s$; and when $\alpha=1$ and $\beta=0$, then $T_i=T_i^w$. Also note that the objective function can include other performance metrics such as the energy required to move the elevators and the number of stops made by the elevators. The optimization of the objective function (4) is subject to constraints (1), (2) and (3). This example should not be read as limiting the use of other constraints.

The formulation of the objective function is applicable to arbitrary building configurations and traffic patterns since no specific assumption has been made about them.

Figure 3:
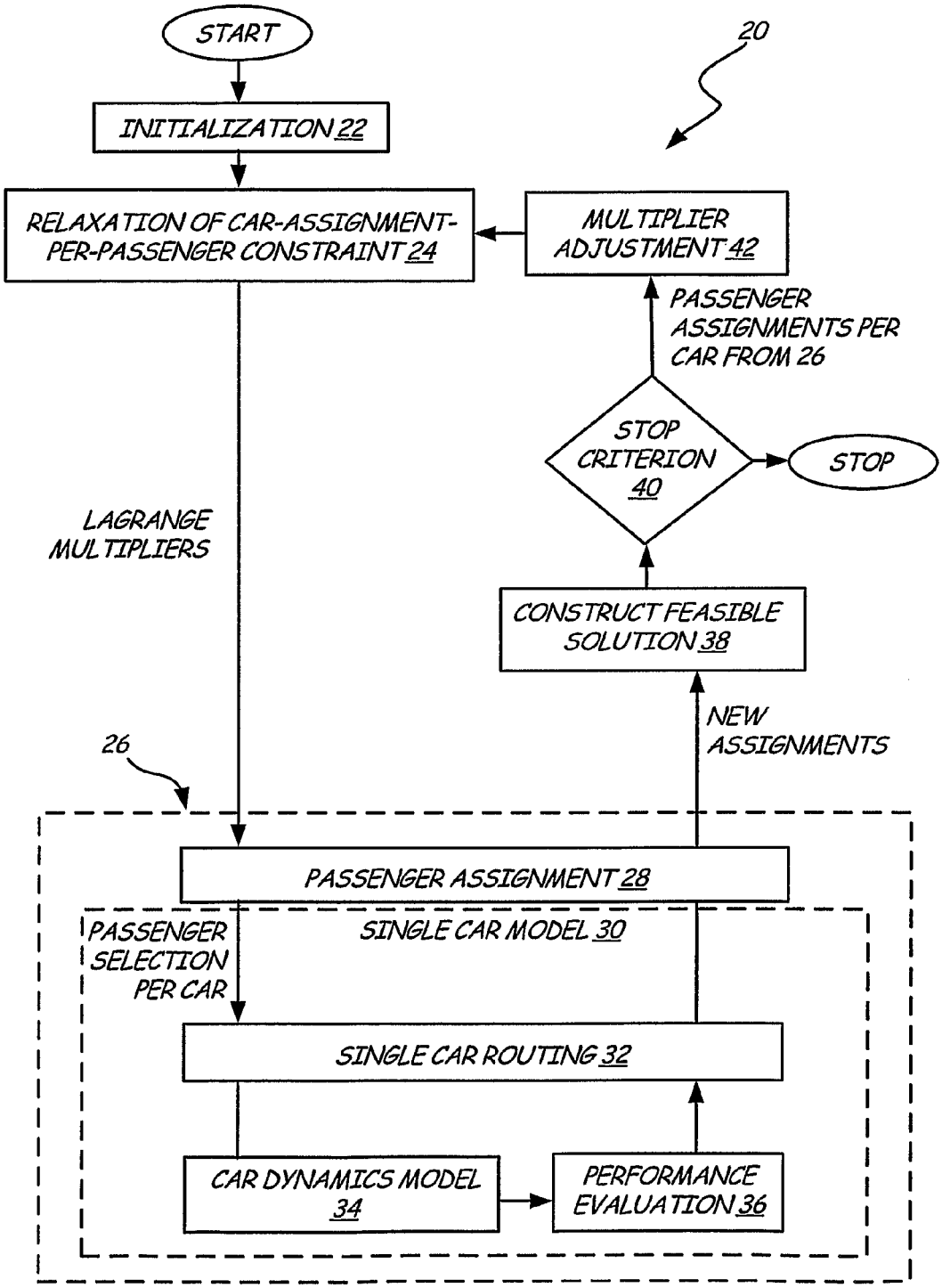
FIG. 3 is a flow diagram showing the two-level solution methodology.

As described herein, the coupling passenger-car assignment constraints (1) are linear inequality constraints, and car capacity constraints (2) and car dynamics (3) are embedded within individual car simulation models. The objective function (4) is therefore first transformed into a form to facilitate the decomposition of the problem into individual car subproblems. A decomposition and coordination approach is then developed through the relaxation of coupling passenger-car assignment constraints (1) resulting in independent car subproblems. A car subproblem computes the sensitivity of passenger assignments to the car on system performance. This is accomplished in a series of steps. The first step is to decide which passengers are assigned to the particular car. This assignment step can be solved using a local search method. In one such method, passenger selections are first quickly evaluated and ranked by using heuristics based on the ordinal optimization concept that ranking is robust even with rough evaluations, as known in the art. With this ranking information, top selections are evaluated for exact performance by dynamic programming to optimize single car dispatching. Within the surrogate optimization framework, a selection "better" than the previous one is "good enough" to set multiplier updating directions. Individual cars are then coordinated through the iterative updating of multipliers by using surrogate optimization for near-optimal solutions. The framework of this approach is shown in FIG. 3. The specific steps are presented below.

FIG. 3 shows the two-level solution methodology 20 for solving each snapshot problem. The method begins at initialization step 22. A decomposition and coordination approach is developed through the relaxation of coupling passenger-car assignment constraints 24 to create a relaxed problem. The relaxed problem is decomposed into car subproblems 26, which are independently solved. The first step 28 within the car assignment problem is to select the passengers to assign to the car. The second step uses single car model 30 to identify near-optimal single car routing 32 32 using car dynamics model 34 followed by the evaluation of the resulting performance 36. Once all car subproblems have been solved, the next step is to construct a feasible passenger to car assignment 38, followed by the use of a stopping criterion 40. Criterion 40 determines when the solution is sufficiently near-optimal to stop further interations. If not, in the next iteration multipliers are updated 42 using gradient information from the car subproblems 26.

To decompose the objective function (4) into individual car subproblems, the objective function should be additive in terms of individual cars. The objective function in (4) is therefore rewritten by using (1):

$$J = \sum_{i=1}^{I}\left(T_i\sum_{j=1}^{J}\delta_{ij}\right) = \sum_{j=1}^{J}\sum_{i=1}^{I}(\delta_{ij}T_i). \tag{6}$$

With this additive form, assignment constraints (1) are relaxed by using nonnegative Lagrange multipliers $\{\lambda_i\}$:

$$\begin{aligned} L(\lambda, \delta) &= \sum_{j=1}^{J}\sum_{i=1}^{I}(\delta_{ij}T_i) + \sum_{i=1}^{I}\lambda_i\left(1 - \sum_{j=1}^{J}\delta_{ij}\right) \\ &= \sum_{j=1}^{J}\sum_{i=1}^{I}(\delta_{ij}T_i - \lambda_i\delta_{ij}) + \sum_{i=1}^{I}\lambda_i. \end{aligned} \tag{7}$$

By collecting all the terms related to j from (7), the subproblem for car j is obtained as $$\min_{\left\{\begin{matrix}\delta_{ij},\forall i\in S_c,\forall j\\ t_i^p,\forall i\in S_c\cup S_p\end{matrix}\right\}} L_j, \quad \text{with } L_j \equiv \sum_{i=1}^{I}(\delta_{ij}T_i - \lambda_i\delta_{ij}), \tag{8}$$

subject to capacity constraints (2) and car dynamics (3).

A novel and efficient approach is used to solve the subproblem (8) for car j. Car subproblem (8) is to obtain an optimal passenger selection and an optimal routing of selected passengers for a given set of multipliers. In view of the large search space involved, it is difficult to obtain optimal solutions. Nevertheless, based on the surrogate sub-gradient method, approximate optimization of only one or a few subproblems under certain conditions is sufficient to generate a proper direction to update the multipliers. See, X. Zhao, P. B. Luh, and J. Wang, "The Surrogate Gradient Algorithm for Lagrangian Relaxation Method," Journal of Optimization Theory and Applications, Vol. 100, No. 3, March 1999, pp. 699-712. By utilizing this property, the goal is to obtain a better passenger selection with an effective dispatching of the selected passengers by using a local search method. Subproblems are independently solved by using a local search method in conjunction with heuristics and dynamic programming.

Figure 4:
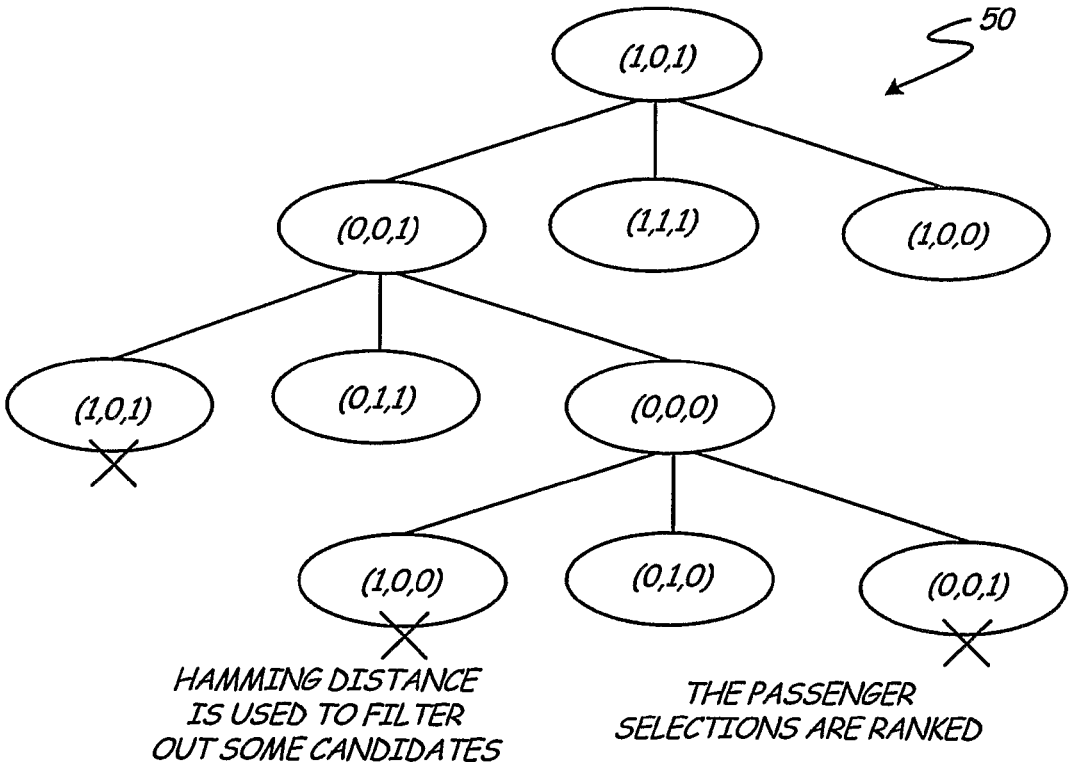
FIG. 4 is a diagram illustrating a local search.

An example of an embodiment of passenger assignment 28 shown in FIG. 3 is the local search method 50 illustrated in FIG. 4. First, passenger selections are generated based on a tree search technique by varying one passenger at a time. For each node in the local search 50 (i.e., given a passenger selection $\delta_{ij}$), the problem is to evaluate the performance with optimized single car dispatching as follows, $$\min_{\{t_i^p,\forall i\in S_c\cup S_p\}} \sum_{i=1}^{I}\delta_{ij}T_i. \tag{9}$$

In local search 50, passenger selections are first quickly evaluated and ranked by using heuristics based on the ordinal optimization concept that ranking is robust even with rough evaluations.

The top candidate from local search 50 is then evaluated by single car model 30 for exact performance as shown in FIG. 4. If it is better than the original selection, then it is accepted. Otherwise, the second best is evaluated. If no better selection is found, the original selection is maintained and the next subproblem is solved. Within the surrogate optimization framework, a selection "better" than the previous one is "good is enough" to set multiplier updating directions.

The pseudo code of the local search procedure is shown in TABLE 1.

TABLE 1

```
Procedure Local Search (car j)
    # Based on the ordinal optimization concept that ranking is robust even with rough evaluations,
    each node is quickly evaluated by using heuristics, and a ranked list of candidates is thus
    obtained: while TRUE
        # Given the current passenger selection to car j
        if (Local minimum is found or the maximum number of iterations has been reached)
            Choose the best passenger selection so far as the top candidate
            Stop
        end if
```

TABLE 1-continued

```
        Generate a neighborhood by varying one passenger at a time
        for (Each passenger selection in the local search neighborhood)
            Evaluate the passenger selection by using single-car routing policy and car
            dynamics model
        end for
        Update the current passenger selection with the best one in the neighborhood
    end while
    # The top candidate is evaluated by using DP for exact performance. If it is better than the
    original selection, then it is accepted. Otherwise, the second best is evaluated by DP, etc:
    while TRUE
        Choose the top candidate from the list
        Evaluate it by using dynamic programming
        if (Better than the original assignment)
            Accept it and stop
        else
            Remove it from the list
        end if
    end while
end Procedure
```

The performance resulting from a particular choice of passenger to car assignments can be evaluated once a policy for single car routing has been defined. This method allows any choice of single car routing policy. For example, a popular single car routing policy known as full collective, as known in the art.

In one method to solve the problem (equation 9), the single car model 30 is implemented as a simulation-based dynamic programming (DP) method that optimizes the car trajectory and evaluates the passenger selection. A specific example of single car model 30 that can be used has a novel definition of DP stages, states, decisions, and costs to reduce computational requirements, as is described below. The key idea is that for a one-way trip, if the stop floors are given, then the car trajectory is uniquely specified. With this, a stage is defined to be a one-way trip of the car without changing its direction.

For a stage starting at time $t_k$, a DP state includes the car position $f_j$ at $t_k$, the car direction $d_j$, and the status of the set $S_k$ of passengers that have not yet been delivered to their destination floors at $t_k$ (the status of passenger i includes the arrival time $t_i^a$, the arrival floor $f_i^a$, and the destination floor $f_i^d$). The state is thus represented by $$X_k=(t_k, f_j, d_j, \{t_i^a, f_i^a, f_i^d \mid \forall i \in S_k\}). \tag{10}$$

The decisions for a state include stop floors, the reversal floor where the car changes its direction, and passengers to be delivered in the current stage (limited to those traveling between the stop floors). The decision can thus be represented by $U_k=\{u_i \mid \forall i \in S_k\}$, where $u_i$ is a zero-one decision variable equal to one if passenger i is delivered to the destination floor in stage k and equal to zero otherwise. For passengers already inside car j at $t_k$, $u_i$ always equals one. For passengers with identical arrival and departure floors, they are picked up according to the first-come-first-serve rule.

Focusing on waiting time and transit time performance metrics for the purpose of illustration, given $X_k$ and $U_k$, the pick up time $t_i^p$ and the departure time $t_i^d$ of passengers delivered in stage k and the start time $t_{k+1}$ of stage k+1 are obtained through single car simulation. Note that for each passenger, the wait time or transit time is additive over his/her time delay in each stage (i.e., each one-way trip). Therefore the objective function in (9)—a weighted sum of wait times and transit times of all passengers—can be divided into stages as follows.

Figure 5:
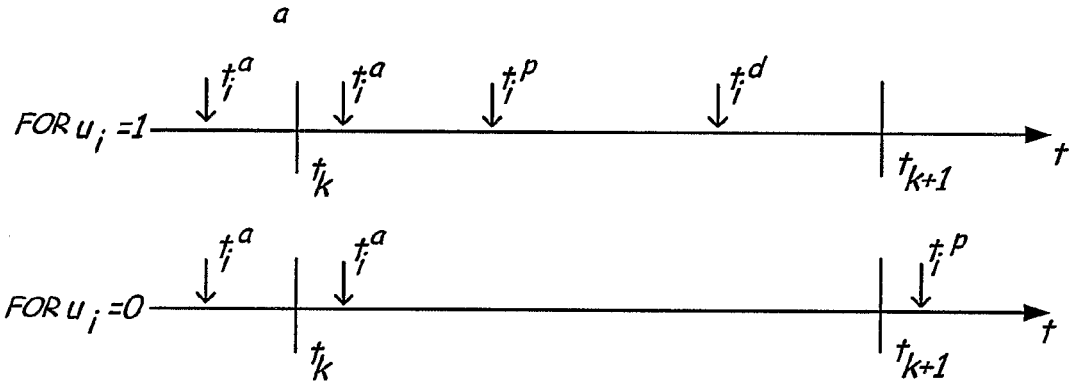
FIG. 5 is a diagram illustrating stagewise cost.

FIG. 5 is an illustration for stage-wise cost. Stage k starts at time $t_k$ and ends at time $t_{k+1}$. For any passenger delivered in stage k ($u_i$=1), the wait time in stage k is $t_j^p$−max ($t_k$, $t_i^a$), and the transit time is $t_i^d$−$t_i^p$. For any passenger not delivered in stage k ($u_i$=0), the wait time in stage k is $t_{k+1}$−max ($t_k$, $t_i^a$), and the transit time is 0. The objective function (□*wait time+□*transit time) can thus be incorporated in the following stage-wise cost:

$$g_k(X_k, U_k) = \sum_{i \in S_k, u_i=1} \lfloor \alpha(t_i^p - \max(t_k, t_i^a)) + \beta(t_i^d - t_i^p) \rfloor + \sum_{i \in S_k, u_i=0} \alpha(t_{k+1} - \max(t_k, t_i^a)) \tag{11}$$

With the above definitions, an optimal trajectory for single dispatching is obtained by using forward dynamic programming.

Based on the surrogate subgradient method, approximate optimization of only one or a few subproblems under certain conditions is sufficient to generate a proper direction to update the multipliers. First, all the subproblems should be minimized at the initial iteration. A quick way to initialize multipliers is based on the observation that when $\{\square_i\}^0=\{0\}$, the optimal solution for all the subproblems is $\{\square_{ij}^* \mid \forall j\}^0=\{0\}$ (See pseudo code in TABLE 2). The initial values of $\{\square_i\}^0$ and $\{\delta_{ij}\}^0$ can thus be easily obtained. Given the current solution ($\{\square_i\}^k$, $\{\delta_{ij}\}^k$) at the $k^{th}$ iteration, the surrogate dual is $$\begin{aligned} \tilde{L}^k &= \tilde{L}(\{\lambda_i^k\}, \{\delta_{ij}^k\}) \\ &= \sum_{j=1}^{J} \sum_{i=1}^{I} (\delta_{ij}^k T_i^k) + \sum_{i=1}^{I} \lambda_i^k \left(1 - \sum_{j=1}^{J} \delta_{ij}^k\right) \\ &= \sum_{j=1}^{J} \sum_{i=1}^{I} (\delta_{ij}^k T_i^k - \lambda_i^k \delta_{ij}^k) + \sum_{i=1}^{I} (\lambda_i^k). \end{aligned} \tag{12}$$

The Lagrangian multipliers are updated according to $$\lambda_i^{k+1}=\lambda_i^k+s^{k-k} g_i, \tag{13}$$

where the component of the surrogate sub-gradient is $$\tilde{g}_i^k = \left(1 - \sum_{j=1}^{J} \delta_{ij}^k\right), \tag{14}$$

with step size $s^k$ satisfying $$0 < s^k < \left(L^* - \tilde{L}^k\right) \Big/ \sum_{i=1}^{I} (\tilde{g}_i^k)^2. \tag{15}$$

To estimate the optimal dual L*, a feasible $\{\delta_{ij}\}^k$ is constructed every five iterations and the feasible cost is evaluated. At the $k^{th}$ iteration, $P^k$ is then defined as the minimal feasible cost obtained so far. In view that $P^k$ is a upper bound of $L^-$ and the surrogate dual is a lower bound of L*, the optimal dual is estimated as follow, $$\hat{L}^* = (P^k + \tilde{L}^k)/2. \tag{16}$$

With the estimated optimal dual cost, the step size is $$s^k = \rho\left(\hat{L}^* - \tilde{L}^k\right) \Big/ \sum_{i=1}^{I} (\tilde{g}_i^k)^2, \text{ where } 0 < \rho < 1. \tag{17}$$

Given $\{\square_i\}^{k+1}$, choose car subproblem j (j=k mod J) and perform "approximate optimization" to obtain $\{\square_{ij}\}^{k+1}$ by using local search in conjunction with heuristics and DP (See Table 2) such that $\{\square_{ij}\}^{k+1}$ satisfies $$L_j(\{\lambda_i^{k+1}\},\{\delta_{ij}^{k+1}\}) < L_j(\{\lambda_i^{k+1}\},\{\delta_{ij}^{k}\}). \tag{18}$$

Thus $\{\square_{ij}\}^{k+1}$ for car j (j=k mod J) is obtained while $\{\square_{ij'}|j' \neq j\}^{k+1}$ for other cars are kept at their latest available values. With the updated values $\{\square_i\}^{k+1}$ and $\{\delta_{ij}\}^{k+1}$, the process repeats.

If the duality gap is less than □ or the maximum number of iterations has been reached, the algorithm stops. For a case with a large time window, the upper bound on the number of iterations is removed. The reason is that this case is for offline optimization, and the major concern is solution optimality as opposed to the CPU time.

If the algorithm stops with an infeasible solution, a heuristic rule is used to construct a feasible solution as follows, Identify any passengers who has a violated assignment, i.e., $$\sum_{j=1}^{J} \delta_{ij} \neq 1$$

Generate a random number j' between 1 and J

Assign this passenger to car j' so that $\delta_{ij'}=1$, and $\delta_{ij'}=0$ for $\forall j \neq j'$

TABLE 2

```
Procedure Surrogate Subgradient Method
    # Initialize
    Set {λ_i}^0 = {0} since in this case {δ_ij* | ∀j}^0 = {0}
    # Iterate
    while TRUE
        # Given the current solution ({λ_i}^k, {δ_ij}^k) at the k^th iteration
        if (duality gap is less than ϵ or the maximum number of iterations has been reached)
            Stop
        end if
        Update multipliers to obtain {λ_i}^(k+1)                    (equation 13)
        Choose car subproblem j (j = k mod J)
        # Obtain {δ_ij}^(k+1) by using local search
        Call procedure Local Search (car j) to find a better passenger selection {δ_ij}^(k+1) satisfying
            L_j ({λ}^(k+1), {δ_ij}^(k+1)) < L_j ({λ_ij}^(k+1), {δ_ij}^k)    (equation 18)
        # With surrogate optimization, local search is good enough to set multiplier updating
        directions
        if no better selection is found
            The original selection is maintained and the next subproblem is solved
        end if
    end while
end Procedure
```

A rolling horizon scheme is used in conjunction with windows. Snapshot problems are re-solved periodically.

Figure 6:
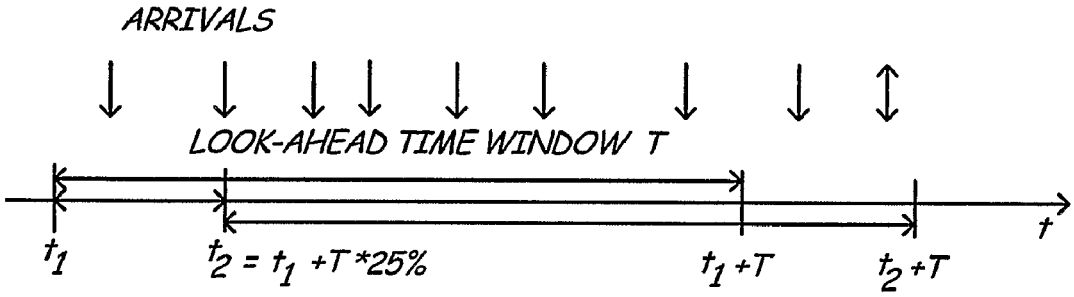
FIG. 6 is a diagram showing nonzero look-ahead moving windows with 75% overlapping.

FIG. 6 illustrates the case when the look-ahead window is of finite time duration. In FIG. 6, nonzero moving windows are shown which are 75% overlapping. The window size is T, the rescheduling interval is 0.25 T, and the rescheduling points are $t_1$ and $t_2$. Suppose that the current time instant is $t_2$. All the traffic information between $t_2$ and $t_2$+T is assumed given. Cases with different levels of advanced traffic information can thus be modeled by appropriately adjusting T.

(Cases with Little or No Future Traffic Information)

For cases with little or no future traffic information as modeled by having small or zero time windows, the optimization of the above snapshot problems is "myopic," and the overall performance may not be good. For example, suppose that there are four elevators available at the lobby and four passengers with different destination floors arrived at the lobby about the same time in up-peak traffic. The "best" decision for this snapshot problem, e.g., to minimize the total service time, would be to dispatch one elevator for each passenger. This, however, would result in "bunching" of elevators, i.e., elevators moving close to each other. Passengers who arrive a little bit later than the fourth passenger then would have to wait till one of the elevators returns to the lobby, resulting in poor overall performance. Bunching is less of an issue for cases with sufficient future information.

Another concern is to reduce passenger wait time for two-way traffic with low passenger arrivals and little or no future information. It has been shown that performance can be improved by "parking" elevators in advance at floors where elevators are likely to be needed. Our method presented above has been extended to address these two issues in a coherent manner.

(An Optimization-Statistical Method for Up-Peak)

To overcome the myopic difficulty of snapshot solutions for up-peak with little or no future traffic information, consider a stationary model where passengers arrive at a time-invariant rate with a given destination floor distribution. Based on a statistical analysis, it has been shown that good steady-state performance can be achieved for such up-peak traffic by releasing elevators from the lobby at an equal time interval, assuming that elevator capacity is sufficient to accommodate new arrivals within the elevator "inter-departure time." This inter-departure time is calculated as the round trip time of a single elevator divided by the number of elevators, with the round trip time depending on traffic statistics.

Based on the above, the method presented above is strengthened by incorporating online statistical information beyond what is available within the time window, and by adopting the inter-departure time concept. The resulting "optimization-statistical method" for up-peak is to add two "elevator release conditions" to the formulation to space elevator departures from the lobby. Specifically, for an even flow of passengers, elevators are held at the lobby and are released every inter-departure time T, i.e., $$t^m + \iota \leqq t^{m+1}, \tag{19}$$

where $t^m$ and $t^{m+1}$ are successive elevator departure times. With (19), elevators wait for the future passenger arrivals. The inter-departure time X needs to be calculated online in the absence of the stationarity assumption. This is done by extending the method by using arrivals and destinations available within the time window and statistical information beyond the time window, with the latter obtained statistically based on recent passenger arrivals at each floor and their destinations. To cover burst arrivals, elevators are released when a certain percentage of elevator capacity is filled, i.e., $$\sum_{t^m \leq t_i^p < t^{m+1}} \delta_{ij} > \nu C_j, \tag{20}$$

where ν is a given percentage of elevator capacity.

To solve the problem, the decomposition and coordination approach presented above is used, and the above two conditions (19) and (20) are used to trigger the release of elevators at the lobby when solving individual subproblems within the surrogate optimization framework. Specifically, when solving a particular elevator subproblem, decisions of other subproblems are taken at their latest available values, and the two release conditions are incorporated within the local search procedure.

(Parking Strategy for Two-Way with a Low Arrival Rate)

To develop a parking strategy for two-way traffic with little or no future information, our idea is to divide the building into a number of non-overlapping "zones," each consisting of a set of contiguous floors. Probabilities that the next passenger would arrive at individual zones are estimated, and "free" elevators without passenger assignments are parked at zones where they are likely to be needed. To avoid excessive move of elevators, floors in the same zone are not differentiated.

Specifically, suppose that an elevator becomes free, making the total number of free elevators J', where $1 \leqq J' \leqq J$. The probability that the next passenger would arrive at floor f, $P^f$, is estimated statistically based on recent arrival information, and the probability that the next passenger would arrive at zone n is $$P_n = \sum_{f \in Z_n} P^f.$$

The number of desired elevators parked at zone n is then calculated as $\lfloor j' \times P_n \rfloor$ (a truncated integer). By comparing $\lfloor J' \times P_n \rfloor$ with the number of elevators already parked in various zones, the zones needing a free elevator are identified. The new free elevator is then parked at one of these zones nearby. This parking strategy is embedded within our optimization-statistical method to form a single algorithm, and is invoked when an elevator becomes free.

(Scheduling in the Emergency Mode)

In addition to good performance during normal operations, group elevator scheduling has a new significance on speedy egress driven by homeland security concerns. In a high-rise building, stairs are inefficient for emergency evacuation because they become congested, people slow down during the long distance from top floors to the ground, and the elderly and disabled might not be able to use stairs at all. H. Hakonen, "Simulation of Building Traffic and Evacuation by Elevators," Licentiate Thesis, Department of Engineering Physics and Mathematics, Helsinki University of Technology, 2003. The potential of using "safe elevators" for evacuation has been demonstrated for certain cases such as the detection of chemical or biological agents, or fires in one wing of a building J. Koshak, "Elevator Evacuation in Emergency Situations," Proceedings of Workshop on Use of Elevators in Fires and Other Emergencies, Atlanta, Ga., March, 2004, pp. 2-4. Coordinated emergency evacuation is a key egress method, where occupants at each floor are evacuated in a coordinated and orderly way. As a key egress method, coordinated emergency evacuation is considered here, where occupants at each floor are evacuated in a coordinated and orderly manner. Based on pre-planning, traffic is assumed balanced between elevators and stairs to minimize the overall egress time. The elevator egress time $T_e$ is defined as the time required to evacuate all the passengers assigned to elevators, i.e., $$\max_i \{t_i^d\}.$$

Suppose that the traffic information including arrival times, arrival floors, and the destination floor (i.e., the lobby) is known within the time window, and occupants follow the passenger-to-elevator assignment decisions. Then, the problem is to minimize the elevator egress time $T_e$, i.e., $$\min_{\{\delta_{ij}, \varphi_j, \forall i \in S_n, \forall j\}} J_e, \text{ with } J_e \equiv T_e^2, \tag{21}$$

subject to passenger-to-elevator assignment constraints and individual elevator constraints, given positions and directions of elevators.

The objective function in (21) is not additive in terms of elevators. Therefore, the decomposition and coordinate approach described previously cannot be directly applied to solve this problem. Nevertheless, let $T_{cj}$ be the time required for elevator j to evacuate all the passengers assigned to it, i.e., $$\max_i \{t_i^d \mid \delta_{ij} = 1\}.$$

By requiring that $T_{cj}$ be less than or equal to the egress time $T_e$ for all j, the objective function can be written in an additive form with the addition of the following linear inequality "egress time constraints," one per elevator:

$$T_{cj} \leq T_e, \forall j \tag{22}$$

With (22), the optimization-statistical method is applied. An additive Lagrangian function is obtained by relaxing the assignment constraints with nonnegative multipliers $\{\lambda_i\}$, and the egress time constraints (22) with nonnegative multipliers $\{\mu_j\}$, i.e., $$\begin{aligned} L(\lambda, \delta) &= T_e^2 + \sum_{i=1}^{I} \lambda_i \left(1 - \sum_{j=1}^{J} \delta_{ij}\right) + \sum_{j=1}^{J} \mu_j (T_{cj} - T_e) \\ &= \left(T_e^2 - \sum_{j=1}^{J} \mu_j T_e\right) + \sum_{j=1}^{J} \left(\mu_j T_{cj} - \sum_{i=1}^{I} (\lambda_i \delta_{ij})\right) + \sum_{i=1}^{I} \lambda_i. \end{aligned} \tag{23}$$

Elevator subproblems are then constructed and solved, and a new "egress-time subproblem" for $T_e$ is introduced, as presented below.

By collecting all the terms related to elevator j from (23), the subproblem for elevator j is obtained as $$\min_{\{\delta_{ij}, \varphi_j, \forall i \in S_n\}} L_j, \text{ with } L_j \equiv \mu_j T_{cj} - \sum_{i=1}^{I} (\lambda_i \delta_{ij}), \tag{24}$$

subject to individual elevator constraints. This subproblem may be solved by using an ordinal optimization-based local search as presented previously, where nodes of the search tree are first roughly evaluated and ranked by using the "three-passage heuristics." The top ranked nodes are then exactly optimized by using DP, where $T_{cj}$ is represented by the following stage-wise cost:

$$g_k(x_k, u_k) = t_{k+1} - t_k. \tag{25}$$

The additional egress-time subproblem is obtained by collecting all the terms related to $T_e$ from (23):

$$\min_{\{T_e \geq 0\}} L_{J+1}, \text{ with } L_{J+1} \equiv T_e^2 - \sum_{j=1}^{J} \mu_j T_e. \tag{26}$$

In view of its quadratic form with a nonpositive linear coefficient, this subproblem can be easily solved. The component of the surrogate subgradient used to update $\{\mu_i\}$ at the $n^{th}$ iteration is $$\tilde{g}_j^n = T_{cj}^n - T_e^n. \tag{27}$$

Multiplier updating iteration follows what was described before for near-optimal solutions. The present invention provides a consistent way to model and improve group elevator control with advance traffic information. A look-ahead window is first introduced to model advance traffic information where traffic information within the window is known, and information outside the window is ignored. Cases with different levels of advance traffic information can be modeled by appropriately adjusting the window size. Key characteristics of group elevator scheduling are used to establish an innovative two-level formulation, with passenger to car assignment at the high level, and the dispatching of individual cars at the low level. This formulation is applicable to different building configurations and traffic patterns because no specific assumption is made about them. Details of single car dynamics are embedded within individual car simulation models. The formulation is thus flexible to incorporate different strategies for single car dispatching, including a simulation-based dynamic programming method.

To achieve near-optimal passenger to car assignments and near-optimal individual car routing for the assignments based on the advance traffic information, a decomposition and coordination approach is used through the relaxation of coupling passenger-car assignment constraints. Car subproblems are independently solved. In the local search, passenger selections are first quickly evaluated and ranked by using heuristics. With this ranking information, top selections are then evaluated for exact performance by dynamic programming with a novel definition of stages, states, decisions, and costs to improve single car routing. Individual cars are then coordinated through the iterative updating of Lagrange multipliers by using surrogate optimization for near-optimal solutions.

Although the present invention has been described with reference to examples and preferred embodiments, workers skilled in the art will recognize that changes may be made in form and detail without departing from the spirit and scope of the invention.

The invention claimed is:

1. A method for scheduling a group of elevators, the method comprising:

modeling passenger traffic information representing actual and predicted requests for service within a look-ahead time window to create a snapshot problem; and solving the snapshot problem by minimizing an objective function based on total service time of all passengers in the snapshot problem to determine passenger to car assignments and car dispatching.

2. The method of claim 1, wherein solving the snapshot problem comprises:

selecting optional passenger to car assignments for each elevator car; and determining optimal dispatching of individual cars based on the selected passenger to car assignments using car simulation models.

3. The method of claim 1, wherein the objective function comprises a weighted sum of wait times and transit times of all passengers.

4. The method of claim 2, wherein the weighted sum for all passengers I is $$J \equiv \sum_{i=1}^{I} T_i,$$

and for passenger i, $Ti = \alpha T_i^W + \beta T_i$, where $\alpha$ and $\beta$ are weights $T_i^W$ is a wait time, and $T_i^T$ is a transit time.

5. The method of claim 1, wherein minimizing the objective function comprises:

transforming the objective function into a form to facilitate the decomposition of the snapshot problem;

applying Lagrangian relaxation to the transformed objective function and the coupling passenger-to-car assignment constraints to form a Lagrangian dual function; and solving the Lagrangian dual function within a surrogate optimization framework.

6. The method of claim 5, wherein solving the Lagrangian dual function comprises repeating, until stopping criteria are satisfied, the steps of:

obtaining individual car subproblems through a relaxation of passenger-car assignment constraints;

solving subproblems independently by using a local search method;

coordinating individual cars through iterative updating of multipliers by using surrogate optimization; and constructing feasible assignments if passenger-to-car assignment constraints are violated at the stopping of the multiplier updating iterations by using heuristics for near-optimal solutions.

7. The method of claim 6, wherein the local search method comprises:

evaluating and ranking passenger selections by using heuristics; and based on the ranking, evaluating top selections for exact performance by using dynamic programming.

8. The method of claim 7, wherein during the surrogate optimization, a selection better than a previous one is used to set multiplier updating directions.

9. The method of claim 6, where multipliers are iteratively updated by using surrogate optimization for near-optimal solutions.

10. The method of claim 9, wherein at an initial iteration all multipliers are set to zero and all subproblems are minimized by selecting no passenger.

11. A method for scheduling a group of elevators, the method comprising:

receiving passenger traffic information representing actual and predicted requests for service;

forming an objective function based on total service time of all unassigned passengers within a look-ahead time window;

transforming the objective function into an additive form to facilitate decomposition of the snapshot problem;

applying Lagrangian relaxation to the transformed objective function;

iteratively solving single car subproblems and updating Lagrangian multipliers; and selecting passenger-car assignments and car dispatching for each car.

12. The method of claim 10, wherein the objective function comprises a weighted sum of wait times and transit times of all passengers.

13. The method of claim 12, wherein the weighted sum for all passengers I is $$J \equiv \sum_{i=1}^{I} T_i,$$

and for passenger i, $Ti=\alpha T_i^W+\beta T_i$, where α and β are weights, $T_i^W$ is a wait time, and $T_i^T$ is a transit time.

14. A method of controlling operation of a group of elevators, the method comprising:

receiving passenger traffic information representing actual and predicted requests for service;

selecting, in real time, assignments of passengers to cars and dispatching of cars, based upon the passenger traffic information, individual car simulation models that include car capacity constraints and car dynamics information, and an objective function that is a weighted sum of performance metrics; and dispatching cars based on the selecting.

15. The method of claim 14, wherein optimizing comprises, for each car:

making an optimal selection of passenger assignments; and determining car performance for each passenger assignment.

16. The method of claim 14, wherein the objective function comprises a weighted sum of wait times and transit times of all passengers.

17. The method of claim 16, wherein the weighted sum for all passengers I is $$J \equiv \sum_{i=1}^{I} T_i,$$

and for passenger i, $Ti=\alpha T_i^W+\beta T_i$, where α and β are weights, $T_i^W$ is a wait time, and $T_i^T$ is a transit time.

18. The method of claim 14, wherein the selecting, in real time, assignments of passengers to cars comprises:

modeling passenger traffic information to a current state of the elevator group to create a snapshot problem, wherein the snapshot problem includes a passenger assignment constraint requiring each passenger to be assigned to a single car; and solving the snapshot problem to optimize an objective function by:

relaxing the passenger assignment constraint to transform the snapshot problem into a relaxed problem;

decomposing the relaxed problem into independent car subproblems; and solving all independent car subproblems to generate passenger assignments.

19. The method of claim 18, and further comprising:

supplementing the_passenger traffic information with statistical information; and releasing elevators based upon elevator release constraints relating to elevator inter-departure time and filling of a percentage of elevator capacity.

20. The method of claim 18, and further comprising:

dividing building floors into zones;

identifying zones where elevators are likely to be needed; and parking elevators at the identified zones.

21. The method of claim 18, and further comprising:

including within the objective function an egress-time subproblem.

* * * * *